US005511669A

United States Patent [19]

Bourke

[11] Patent Number: 5,511,669

[45] Date of Patent: Apr. 30, 1996

[54] MEMBRANE WASHING APPARATUS FOR FLOTATION DEVICE

[75] Inventor: Peter G. Bourke, Perth, Australia

[73] Assignee: Supaflo Technologies Pty. Ltd, New South Wales, Australia

[21] Appl. No.: 299,627

[22] Filed: Sep. 2, 1994

[30] Foreign Application Priority Data

Sep. 6, 1993 [AU] Australia ..... PM1057

[51] Int. Cl.[6] ..... B03D 1/02; B03D 1/14

[52] U.S. Cl. ..... 209/164; 209/168; 209/169

[58] Field of Search ..... 209/168, 164, 209/169, 170

[56] References Cited

U.S. PATENT DOCUMENTS

| | | |
|---|---|---|
| 2,182,442 | 12/1939 | Booth . |
| 4,964,576 | 10/1990 | Datta . |
| 4,981,582 | 1/1991 | Yoon . |
| 5,039,400 | 8/1991 | Kallioinen et al. . |
| 5,167,798 | 12/1992 | Yoon et al. . |
| 5,234,112 | 8/1993 | Valenzuela . |
| 5,251,764 | 10/1993 | Niitti . |

FOREIGN PATENT DOCUMENTS

| | | |
|---|---|---|
| 712170 | 5/1951 | United Kingdom . |
| 9314876 | 2/1993 | WIPO . |
| 93/20945 | 10/1993 | WIPO . |

OTHER PUBLICATIONS

"Column Flotation"; Finch and Dobby, Pergamon Press–copyight 1990 pp. 82–88.

Websters New World Dictionary editors Neufeldt & Guralnik pp. 384, 417, 483, 694, 846, 1003, 1006,1051, 1351.

*Primary Examiner*—Thomas M. Lithgow

[57] ABSTRACT

A flotation device (1) which includes a tank (2) to contain a slurry (3) incorporating minerals which are to be extracted. Aeration of the slurry (3) by suitable structure in the device produces a zone (11) of mineralised froth above the slurry (3). A launder (15) directs the mineralised froth away from the tank (2). At least one porous diffusion surface (16) in direct contact with the froth dispenses a washing liquid directly into the froth zone (11).

23 Claims, 1 Drawing Sheet

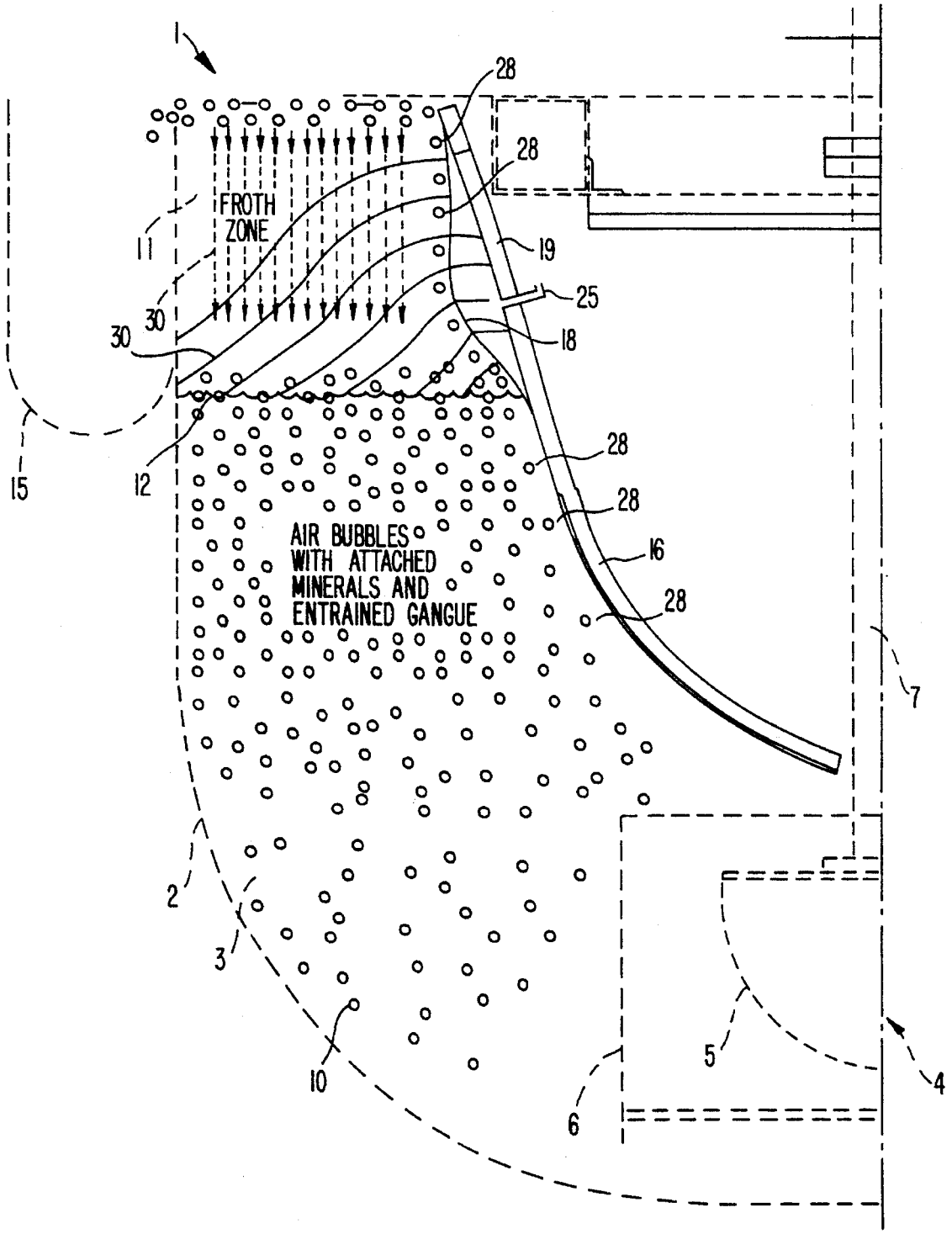
1
28
28
FROTH
ZONE
11
19
25
30
30
18
15
12
28
28
AIR BUBBLES
WITH ATTACHED
MINERALS AND
ENTRAINED GANGUE
16
28
7
2
3
10
5
4
6

MEMBRANE WASHING APPARATUS FOR FLOTATION DEVICE

The present invention relates to froth flotation devices.

Froth flotation is a technique in widespread use in the mining, mineral extraction and mineral processing industries, for concentrating minerals from low grade ores. In this process, the ore is first ground to a relatively fine powder, and mixed with water to produce a slurry or pulp. Specific chemical additives are then mixed with the slurry to develop differences in surface tension between the various mineral species present. The slurry is then aerated, whereupon the preferred hydrophobic species cling to the rising bubbles and float to the surface as a mineralised froth. The froth is then skimmed off via an overflow launder and the desired minerals recovered in a more concentrated form.

Various froth flotation devices are known. Some types incorporate mechanical agitators and rely on blowers to feed pressurised air into the mineral slurry in the vicinity of the agitator. A variation on this type of device is self aspirated, and as such does not require an external source of pressurised air to effect aeration. Other types, known generally as column cells, do not employ mechanical agitation, but rely solely on the vigorous injection of air into the slurry to produce a similar effect. This technology is well known to those skilled in the art, and so need not be described here in more detail.

A significant problem with known froth flotation devices of this type, however, is that whilst the hydrophobic species tend to cling directly to the rising bubbles to form the desired mineralised froth, there is a tendency for unwanted gangue material to be entrained in the interstitial voids formed between the bubbles. The entrained gangue material thereby forms part of the froth, and reduces the purity of the froth concentrate.

In an attempt to overcome this problem, various spraying devices such as spray bars or showers have been developed. These are positioned over or in the froth zone to direct a spray of water into the froth, with the object of washing out the entrained gangue material before the froth passes into the recovery launder. However, whilst this technique does produce a more selective froth, spray water adversely affects froth stability and consequently, some valuable minerals are washed out of the mineralised froth along with the entrained gangue. This in turn reduces the efficiency of the process as a whole.

It is an object of the present invention to provide an improved flotation device which overcomes or substantially ameliorates these disadvantages of the prior art.

Accordingly, in a first aspect, the invention as presently contemplated provides a flotation device comprising a tank to contain a slurry incorporating minerals to be extracted, aeration means to aerate the slurry within the tank and thereby produce a zone of mineralised froth above the slurry, a recovery launder to collect the mineralised froth and to direct said froth away from the tank, and at least one diffusion surface in direct contact with the froth to disperse a washing liquid directly into the froth zone.

Preferably, the diffusion surface is defined by a flexible porous membrane mounted on a backing plate. It should be appreciated, however, that the membrane need not be flexible and that any suitable porous, semi-permeable or perforate surface, substance, or membrane could be used. The flexible membrane is preferably permeable only in an expanded condition under pressure. Wash water supplied between the backing plate and the membrane preferably causes the membrane to expand and in the resultant permeable condition, allow the wash water to diffuse into the froth.

Preferably also, the device includes an inclined guide surface disposed to direct upwardly migrating froth generally toward the launder. In the preferred embodiment, the inclined guide surface is defined at least in part by the porous diffusion surface. In this configuration, the froth migrating upwardly collects wash water from the inclined diffusion surface before migrating progressively toward the launder, thereby promoting uniform distribution of the wash water throughout the froth zone.

Preferably, the diffusion surface is substantially planar, curved, or is defined by the outer surface of one or more conduits extending through the froth zone.

In a second aspect, the invention provides a method of recovering minerals from a slurry contained in a tank forming part of a flotation device, said method comprising the steps of aerating the slurry within the tank and thereby producing a zone of mineralised froth above the slurry, disbursing a washing liquid directly into the froth zone by means of a diffusion surface in direct contact with the froth such that washing liquid infused into the froth progressively washes out entrained gangue material, collecting the mineralised froth in a recovery launder, and directing said froth away from the tank via said launder.

Preferably, the method comprises the further step of directing said washing liquid under pressure between said diffusion surface and an adjacent backing plate to enhance migration of the pressurised washing liquid into the froth zone.

In the preferred embodiment, the diffusion surface comprises a flexible membrane which is substantially permeable only in an expanded condition, the method comprising the further step of regulating the flow of the washing liquid under pressure between the diffusion surface and the backing plate to expand the membrane into a permeable condition whilst said pressure is maintained, and to allow the membrane to relax into a substantially impermeable condition when said pressure is reduced.

A preferred embodiment of the invention will now be described, by way of example only, with reference to the accompanying drawing which is a cross sectional side elevation showing a flotation device according to the invention.

BRIEF DESCRIPTION OF THE DRAWING

The drawing is a cross sectional side elevation showing the flotation device according to the invention.

Referring to the drawing, the invention provides a flotation device 1 comprising a tank 2 adapted to contain slurry 3 incorporating minerals to be extracted. The tank houses a mechanical agitator 4 comprising a rotor blade 5 disposed within a surrounding stator 6. The rotor is driven within the stator via a central drive shaft 7 extending downwardly through the tank.

The device further includes aeration means which in the preferred embodiment comprises a bore (not shown) extending axially through the drive shaft to expel air under pressure from a suitable blower or compressor into the slurry in the vicinity of the agitator. This aeration produces a multiplicity of bubbles 10 which rise to the surface to produce a zone of mineralised froth 11 above the slurry, as described in more detail below. It should be appreciated, however, that in some flotation devices, self-aspiration is employed and in other instances no agitators are used. The present invention is equally applicable to such devices. The slurry 3 and froth zone 11 define an intermediate slurry-froth interface 12. A recovery launder 15 is provided to direct the mineralised froth away from the tank.

The inner periphery of the froth zone 11 is bounded by an inclined guide surface 16 which directs upwardly migrating bubbles and froth generally toward the recovery launder. The guide surface incorporates a flexible porous diffusion surface in the form of a permeable membrane 18 mounted on a backing plate 19, with the membrane in direct contact with the froth. A conduit 25 is provided to direct wash water under pressure between the diffusion membrane 18 and the backing plate 19. The preferred material for the membrane is a suitable perforated rubber, which is permeable only under pressure and as such, does not generally permit blockages of the pores or leakage when the wash water supply pressure is withdrawn. A further advantage of a flexible membrane material of this type is that if blockages do occur, the pores can expand under the influence of the pressurised wash water until the obstruction is expelled.

Turning now to describe the operation of the device in more detail, once the tank is filled to the appropriate level with slurry, the agitator 4 is activated and the associated aeration mechanism brought into operation. The resultant aeration creates bubbles 10 which begin to rise to the surface. Under the influence of appropriate chemical additives, the rising bubbles attract the preferred hydrophobic mineral species by virtue of differential surface tension. In this way, the minerals cling to the rising bubbles, which float to the surface to form the zone 11 of mineralised froth. As the bubbles rise, they are directed progressively outwardly toward the launder 15 by the inclined guide surface 16 to produce the relatively narrow froth zone. As previously discussed, however, there is a tendency for unwanted gangue material to be entrained in the interstitial voids formed between the bubbles and this entrapped gangue material also forms part of the froth.

Once the froth zone begins to form, wash water is directed between the flexible diffusion membrane 18 and the adjacent backing plate 19, and hence into the membrane, via conduit 25. The wash water then accumulates behind the membrane which is thereby progressively expanded, and in the expanded condition becomes permeable to permit the wash water to diffuse through the membrane.

Thus, the bubbles 28 migrating upwardly along the inclined guide surface come into direct contact with the expanded membrane and the froth is thereby progressively infused with the wash water permeating through the membrane under the influence of surface tension. The rising bubbles then transport the wash water upwardly and outwardly into the froth zone. As the froth bubbles then migrate outwardly toward the launder, the entrained wash water begins progressively to migrate downwardly through the froth as indicated by arrows 30 to wash out the entrained gangue material. This washing effect results in a proportionately higher mineral content in the froth concentrate which eventually migrates to the launder.

It is also possible at this stage to add specific chemicals via the washwater. These reagents can depress or activate a particular mineral or group of minerals present in the froth zone. The addition of chemicals at this stage can substantially reduce the quantities of reagents used and substantially improve the grade of concentrate produced.

It will be appreciated that by allowing the washing water to diffuse directly from the porous surface of the membrane into the surrounding froth, the wash water is not required to form droplets and so does not impart any substantial kinetic energy to the froth. Consequently, the wash water does not collapse or decompose the froth and thereby result in the loss of valuable minerals, as occurs with conventional spray bar or shower type washing arrangements. Similarly, the bubble size and distribution is not substantially affected, so the addition of wash water by the mechanism of the present invention has little or no effect on overall recovery. It has also been found that the transportation mechanism operating in the present invention, whereby the migrating froth bubbles themselves transport the wash water into the froth zone, results in a remarkably uniform distribution of wash water and produces a marked and consistent increase in the overall efficiency of the process. Thus, the invention represents a commercially significant improvement over the prior art.

Although the invention has been described with reference to specific examples, it will be appreciated by those skilled in the art that the invention may be embodied in many other forms. In particular, it should be appreciated that the diffusion surface need not comprise a flexible membrane and if required the membrane can have reinforcing. Any suitable material, whether flexible or otherwise incorporating one or more porous, semi-permeable, or perforate surfaces permitting the wash water to permeate directly into the surrounding froth can be used. Moreover, any other surface configuration whether flat, curved, prismatic, or otherwise could be used in addition to, or as an alternative to, the inclined guide surface of the preferred embodiment. For example, the membrane can also have a varying number of holes per unit area and be of steel, rubber or any other flexible material. These holes can be of differing angles and shapes, including round and elongated.

I claim:

1. A flotation device comprising:

a tank to contain a slurry incorporating minerals to be extracted;

aeration means to aerate the slurry within the tank and thereby produce a zone of mineralised froth above the slurry;

a recovery launder to collect the mineralized froth and to direct said froth away from the tank; and at least one porous diffusion surface in direct contact with the froth, said diffusion surface being permeable so as to allow a washing liquid to diffuse therefrom into said froth;

2. A flotation device comprising:

a tank to contain a slurry incorporating minerals to be extracted;

an aerator to aerate the slurry within the tank and to produce a zone of mineralised froth above the slurry;

a recovery launder to collect the mineralized froth and to direct said froth away from the tank; and a porous diffusion surface in direct contact with the froth being configured to diffuse a washing liquid into the froth zone and to progressively infuse the froth with wash water permeating through the porous diffusion surface without imparting any substantial kinetic energy to the froth.

3. A flotation device as in claim 1, wherein the diffusion surface includes a flexible porous diffusion membrane mounted on a backing plate.

4. A flotation device as claimed in claim 3, wherein said flexible porous diffusion membrane is substantially permeable only in an expanded condition.

5. A flotation device as claimed in claim 4, further including conduit means to direct the washing liquid under pressure between the diffusion membrane and the backing plate, thereby expanding the membrane into a permeable condition.

6. A flotation device as claimed in claim 5, wherein said membrane is formed from a rubber material.

7. A flotation device as claimed in claim 1, wherein said diffusion surface includes holes at different angles, and wherein the holes at different angles include at least one of round holes or elongated holes.

8. A flotation device as claimed in claim 7, wherein the density of said holes per unit area varies.

9. A flotation device as claimed in claim 1, wherein said diffusion surface defines at least in part an inclined guide surface disposed to direct upwardly migrating froth generally toward the recovery launder.

10. A flotation device as claimed in claim 9, wherein said guide surface is defined by said diffusion surface.

11. A flotation device as claimed in claim 3, wherein said flexible porous diffusion membrane includes reinforcing elements tending to maintain the membrane in a predetermined shape or profile.

12. A flotation device as claimed in claim 1, further including means to introduce additives into the froth via said diffusion surface, to facilitate recovery of selected minerals.

13. A flotation device as claimed in claim 1, further including agitation means in the form of a mixing blade rotatably driven within a surrounding stator via a drive shaft extending into the tank.

14. A flotation device as claimed in claim 13, wherein said aeration means comprises a bore extending axially through said drive shaft to expel pressurised air in the vicinity of the agitation means.

15. A flotation device as claimed in claim 1, wherein said diffusion surface is substantially planar.

16. A flotation device as claimed in claim 1, wherein said diffusion surface is curved.

17. A flotation device as claimed in claim 1, wherein said diffusion surface defines a outer surface extending through the froth zone.

18. A method of recovering minerals from a slurry contained in a tank forming part of a flotation device, said method comprising the steps of:

aerating the slurry within the tank and thereby producing a zone of mineralized froth above the slurry;

diffusing a washing liquid directly into the froth zone without imparting any substantial kinetic energy to the froth by means of a porous diffusion surface in direct contact with the froth such that washing liquid infused into the froth progressively washes out entrained gangue material;

collecting the mineralised froth in a recovery launder; and directing said froth away from the tank via said launder.

19. A method according to claim 18 comprising the further step of directing said washing liquid under pressure between said diffusion surface and an adjacent backing plate to enhance migration of the pressurised washing liquid into the froth zone.

20. A method according to claim 19, wherein said diffusion surface comprises a flexible membrane which is substantially permeable only in an expanded condition, said method comprising the further step of regulating the flow of the washing liquid under pressure between the diffusion surface and the backing plate to expand the membrane into a permeable condition whilst said pressure is maintained, and to allow the membrane to relax into a substantially impermeable condition when said pressure is reduced.

21. A method according to claim 18, comprising the further step of directing the froth toward the recovery launder as it rises within the tank by means of an inclined guide surface defined by said diffusion surface.

22. A method according to claim 18, comprising the further step of introducing additives into the froth via the diffusion surface to facilitate separation of selected minerals.

23. A flotation device comprising:

a tank to contain a slurry incorporating minerals to be extracted;

aeration means to aerate the slurry within the tank and thereby produce a zone of mineralised froth above the slurry;

a recovery launder to collect the mineralized froth and to direct said froth away from the tank; and at least one porous diffusion surface in direct contact with the froth configured for diffusing a washing liquid directly into the froth zone, whereby the washing liquid is introduced into the froth zone without imparting any substantial kinetic energy to the froth and does not collapse or decompose the froth as occurs with conventional spray bar or shower type washing arrangements.

* * * * *

UNITED STATES PATENT AND TRADEMARK OFFICE

CERTIFICATE OF CORRECTION

PATENT NO. : 5,511,669

DATED : April 30, 1996

INVENTOR(S) : Bourke

It is certified that error appears in the above-indentified patent and that said Letters Patent is hereby corrected as shown below:

Abstract: Line 3, after "structure" insert --means--;

Column 4, Line 44, change ";" to --.--;

Signed and Sealed this

Seventeenth Day of September, 1996

*Attest:*

Bruce Lehman

BRUCE LEHMAN

*Attesting Officer*

*Commissioner of Patents and Trademarks*